US006308330B1

(12) United States Patent
Hollander et al.

(10) Patent No.: US 6,308,330 B1
(45) Date of Patent: Oct. 30, 2001

(54) FIRE ESCAPE MASK

(75) Inventors: David Hollander, Brooklyn, NY (US); Anthony F. Pisani, Hasbrouck Heights, NJ (US)

(73) Assignee: The Fire Drill Company, Inc., Rosedale, NY (US)

( * ) Notice: Subject to any disclaimer, the term of this patent is extended or adjusted under 35 U.S.C. 154(b) by 0 days.

(21) Appl. No.: 09/719,655

(22) PCT Filed: Jun. 16, 1999

(86) PCT No.: PCT/US99/13513

§ 371 Date: Apr. 5, 2001

§ 102(e) Date: Apr. 5, 2001

(87) PCT Pub. No.: WO99/65347

PCT Pub. Date: Dec. 23, 1999

(51) Int. Cl.[7] ..... A41D 13/00

(52) U.S. Cl. ..... 2/9; 2/206; 128/206.14; 128/206.19; 128/857; 206/278; 206/803

(58) Field of Search ..... 2/9, 206; 128/857, 128/206.14, 206.19, 206.25, 206.28; 206/278, 803

(56) References Cited

U.S. PATENT DOCUMENTS

| | | | |
|---|---|---|---|
| 3,049,121 | * | 8/1962 | Brumfield . |
| 3,419,136 | * | 12/1968 | Pratt . |
| 3,695,265 | | 10/1972 | Brevik . |
| 4,004,584 | | 1/1977 | Geaney . |
| 4,032,991 | | 7/1977 | Vandeweghe . |
| 4,240,420 | | 12/1980 | Riaboy . |
| 4,269,315 | * | 5/1981 | Boyce . |
| 4,271,834 | * | 6/1981 | Tanaka . |
| 4,354,489 | | 10/1982 | Riaboy . |
| 4,382,440 | | 5/1983 | Kapp et al. . |
| 4,467,799 | | 8/1984 | Steinberg . |
| 4,643,182 | | 2/1987 | Klein . |
| 4,726,365 | * | 2/1988 | Jablonski . |
| 4,856,535 | | 8/1989 | Forbes . |
| 4,984,302 | | 1/1991 | Lincoln . |
| 5,094,236 | | 3/1992 | Tayebi . |
| 5,193,226 | * | 3/1993 | Mortenson . |
| 5,322,060 | | 6/1994 | Johnson . |
| 5,400,780 | | 3/1995 | Nishino . |
| 5,590,646 | * | 1/1997 | Murphy . |
| 5,706,828 | | 1/1998 | Shiota . |

* cited by examiner

*Primary Examiner*—Rodney M. Lindsey
(74) *Attorney, Agent, or Firm*—David M. Klein

(57) ABSTRACT

A smoke mask includes a moistened generally planar mask constructed of a moisture absorbing material that is sized to cover the nose and mouth of a user. A peripheral edge of the mask includes a pressure sensitive adhesive for securing the mask to the face of the user. At least one slit in the peripheral edge of the mask enables the mask to adapt to the contour of the face of the user for obtaining a tight fit of the mask. The mask is used in combination with a pull apart storage structure having first and second generally planar sealing sheets. The sealing sheets are attached to each other along an outer peripheral edge for forming a moisture impermeable hollow interior in which the moistened mask is disposed.

30 Claims, 11 Drawing Sheets

FIRE ESCAPE MASK

BACKGROUND OF THE INVENTION

1. Field of the Invention

The present invention relates generally to a fire escape mask, and more particularly to a moistened fire escape mask and pull-apart storage structure for the mask. The mask and pull-apart storage structure store flat and the mask is configured with slits in a peripheral edge thereof to adhere tightly to the face of the wearer when in use.

2. Description of the Related Art

It is well-known that smoke inhalation is the leading cause of fire deaths, exceeding burn deaths by roughly two to one. The percentage of fire deaths attributable to smoke inhalation has been increasing approximately one percent annually since at least 1979.

Masks suitable for use to prevent or reduce smoke inhalation in a fire are well known in the art. The most common type of mask is that used by professional firefighters. This type of mask consists of a mask portion covering the face, an air tank containing a supply of air, and an air regulator. While this type of mask configuration is suitable for professional firefighters, it is too expensive, complex, and bulky for general consumer use.

According to the fire safety guidebook *Get Out Alive*, which is endorsed by the U.S. Fire Administration, the recommended and almost universally endorsed method of filtering smoke during a fire is to place a wet cloth over the nose and mouth before escaping. The wet cloth absorbs some of the smoke particles and filters noxious substances in the smoke, thereby reducing smoke inhalation. While the use of a wet cloth will not eliminate smoke inhalation, its purpose is to reduce smoke inhalation for a sufficient amount of time to escape the smoky condition. The more time that is available to the person to escape before being overcome by smoke, the greater the likelihood of survival.

A number of devices have been proposed to perform the function of the wet cloth described above. Johnson, U.S. Pat. No. 5,322,060, relates to a fire resistant mask which is made of a flexible breathable porous material impregnated with a solution containing ammonium biborate, ammonium phosphate, ammonium sulfate, sodium dodecyl sulfate, lanolin, lemon fragrance, and water. The mask is breathable and has adsorption capacity for capturing smoke particles and for filtering gases. The mask is constructed of a polyurethane foam covered with terry cloth, and is attached to the face of the user with an elastic strap. The fire resistant masks are packaged wet in moisture barrier packaging.

This type of device suffers from several shortcomings. First, it does not seal well over the mouth and nose of the user. As a result, smoke is able to bypass the mask, thereby reducing its effectiveness. Second, this type of device, while requiring less storage space than the air-canister type mask discussed above, is awkwardly shaped and requires more storage space than is otherwise desirable. As a result, smoke escape masks of this type do not appear to have met with commercial success. Other such bulky mask are shown in Klein, U.S. Pat. No. 4,643,182, and Steinberg, U.S. Pat. No. 4,467,799.

Vandeweghe, U.S. Pat. No. 4,032,991 discloses a smoke escape hood that includes a porous face mask over a portion of the face of the wearer. The smoke escape hood is stored flat, with the face mask kept wet by a moisture impermeable sealing strip. The hood is made of a fire and heat resistant sheet material, such as tetrafluorocarbon, and the mask is constructed of a plurality of rectangular plies of woven fabric. The mask itself is moistened with water or other fluid, and may include granular carbon. When the hood is placed over the head of the wearer, draw strings are provided on the lower portion of the mask to tie the mask to the head of the wearer.

This type of device, and others like it that attach to the wearer using a band, e.g., U.S. Pat. Nos. 4,643,182 and 5,400,780, also do not provide a tight seal around the face of the wearer, thereby enabling smoke to bypass the mask. Also, from a practical standpoint, a user of the Vandeweghe device may be disinclined to wear a hood over his/her head.

Another type of mask that has been proposed utilizes pressure-sensitive adhesive to attach the mask to the face of the user. Devices of this type are shown, for example, in U.S. Pat. Nos. 4,467,799; 4,354,489; 4,240,420; 4,984,302; 4,004,584 and 3,695,265. While, in principle, a pressure-sensitive adhesive attachment to the wearer provides a tight seal for preventing smoke from bypassing the filter, in practice, the design of these masks ignores the fact that the mask may be required to be worn by users of different sizes, with different facial features. In practice, when the masks are applied to the faces of those wearers whose size/facial features do not correspond to the size/shape of the mask, some creasing of the mask will occur, thereby enabling smoke to bypass the mask.

To the inventor's knowledge, despite the near-universal awareness that covering the nose and mouth of a person with a wet cloth in a smoky condition greatly improves the likelihood of survival, no mask for this purpose has achieved commercial success. Accordingly, it is an object of the present invention to provide a fire escape mask that may be stored flat for convenience, that provides a tight seal around the face of wearers of different sizes/facial contours to prevent smoke from bypassing the mask, and that overcomes the other aforementioned shortcomings of prior mask designs.

SUMMARY OF THE INVENTION

The present invention is a smoke mask which includes a moistened generally planar mask constructed of a moisture absorbing material. The mask is sized to cover the nose and mouth of a user. On one side of the mask, a peripheral edge of the mask includes a pressure sensitive adhesive for securing the mask covering the mouth and nose of the user. At least one slit in the peripheral edge of the mask enables the mask to adapt to the contour of the face of the user for obtaining a tight fit of the mask.

The at least one slit is preferably oriented generally perpendicular to the peripheral edge of the mask, and may be positioned on the mask along the cheeks of the user, under the chin of the user, and in combinations thereof. In a preferred embodiment, each portion of the mask along the cheeks of the user includes at least one slit, and the portion of the mask under the chin include a plurality of slits. The mask may also include a flexible strip and/or pressure sensitive adhesive on the mask along a portion thereof adjacent to the nose of the user.

The planar mask may be constructed to include a filtering portion and an attachment lip attached to the periphery of the filtering portion, with the pressure-sensitive adhesive being disposed along a peripheral edge of the attachment lip. In this embodiment the at least one slit is disposed at least partially in the attachment lip.

The above-described smoke mask is used in combination with a pull-apart storage structure having first and second generally planar sealing sheets, each comprising an outer peripheral edge. The first and second sealing sheets are sealingly attached to each other along the outer peripheral edges thereof for forming a moisture-impermeable hollow interior in which the moistened mask is disposed. The combination further includes: i) means for separating the first and second sealing sheets for removing the moistened mask disposed therein, and ii) means for exposing the pressure sensitive adhesive upon removal of the moistened mask from the hollow interior of the pull-apart storage structure.

The sealing sheet are preferably constructed of a plastic material and are sealingly attached to each other using adhesive, heat-sealing, or sonic welding. In one embodiment, the means for separating the first and second sealing sheets comprises pull-apart tabs formed by extending each of the first and second sealing sheets beyond the outer peripheral edge sealingly attaching the first and second sheets, the tabs being sized to be grasped and pulled by a user.

The means for exposing the pressure sensitive adhesive upon removal of the moistened mask from the hollow interior of the pull-apart storage structure preferably comprises; i) a release tape covering the pressure sensitive adhesive and attached to one of the sealing sheets, ii) the surface of the sealing sheet facing the pressure sensitive adhesive being coated with a pressure sensitive adhesive release material, or iii) the sealing sheet facing the pressure sensitive adhesive being constructed of a release tape material.

Also disclosed is an alternative combination mask and pull-apart storage structure. In this embodiment, the mask is generally planar and includes a peripheral edge, with pressure sensitive adhesive on one side of the peripheral edge of the mask for securing the mask to the face of the user. The mask may be sized to cover the mouth or nose of the user, or both. The pull-apart storage structure comprises first and second generally planar sealing sheets, each comprising an outer peripheral edge, the first and second sealing sheets being sealingly attached to each other along the outer peripheral edges thereof for forming a hollow interior in which the mask is disposed.

The combination further comprises means for separating the first and second sealing sheets for removing the mask disposed in the hollow interior of the pull-apart storage structure, and means for exposing the pressure-sensitive adhesive upon removal of the mask from the hollow interior of the pull-apart storage structure.

If desired, the planar mask may be moistened and may be sized to cover the mouth and/or nose of the wearer. The planar mask may also include one or more slits in the peripheral edge of the mask for enabling the mask to adapt to the contour of the face of the user.

Also disclosed is a smoke mask in combination with a pull-apart storage structure in which the pull-apart storage structure includes a backing and a cover, the cover having an outer peripheral edge sealingly attached to the backing for forming a moisture-impermeable hollow cavity in which the moistened mask is disposed. The moistened mask is mounted to a wall of the cavity with the pressure sensitive adhesive being exposed upon removal of the moistened mask from the wall of the cavity. A grasping structure, which is preferably a lip or a tab, on the cover enables separation of the cover from the backing. The backing is preferably constructed of a plastic coated cardboard and the cover is preferably constructed of a clear plastic.

DETAILED DESCRIPTION OF THE INVENTION

Figure 1:
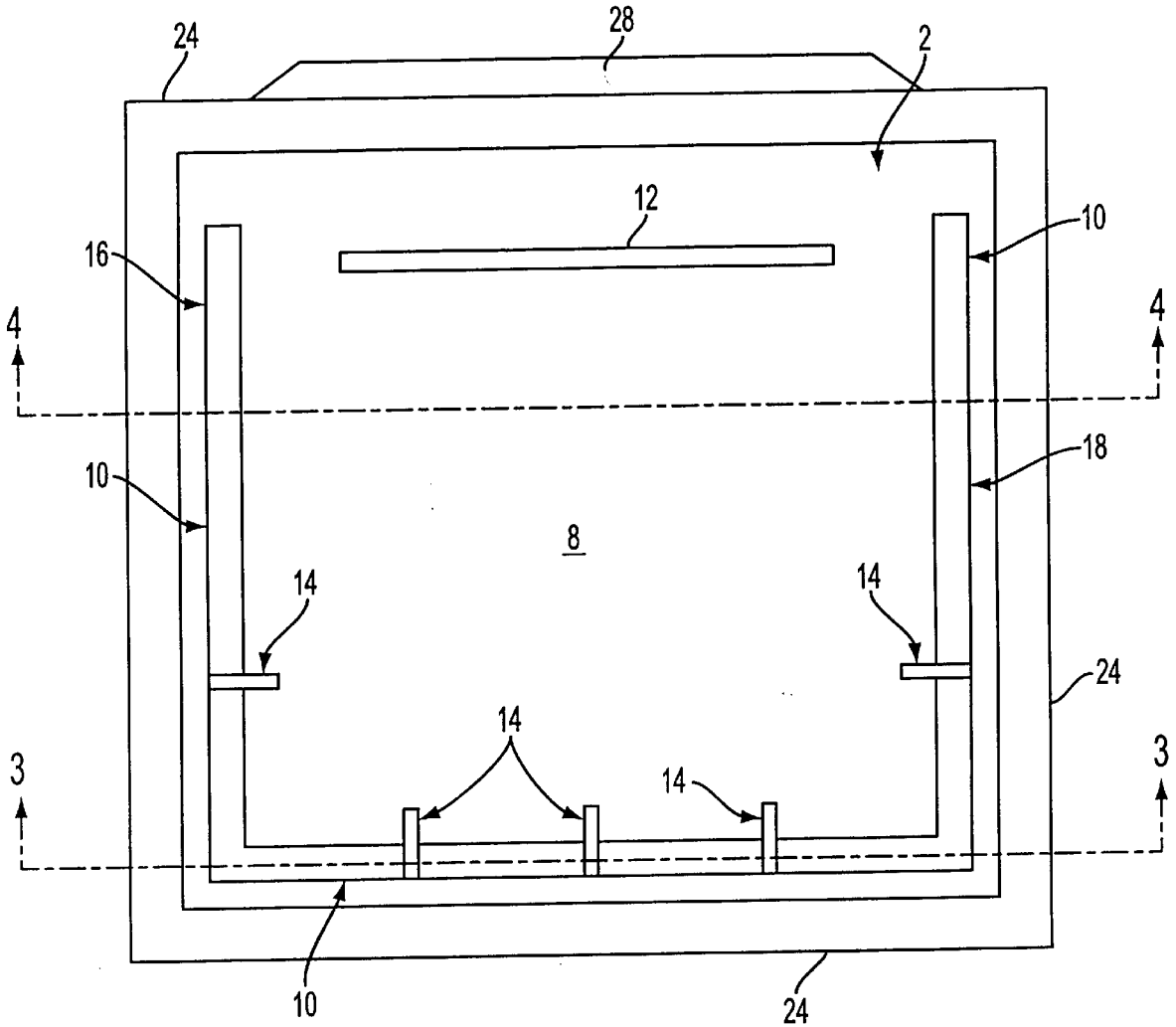
FIG. 1 is a front view of the mask of the invention in the pull-apart storage structure.
Figure 2:
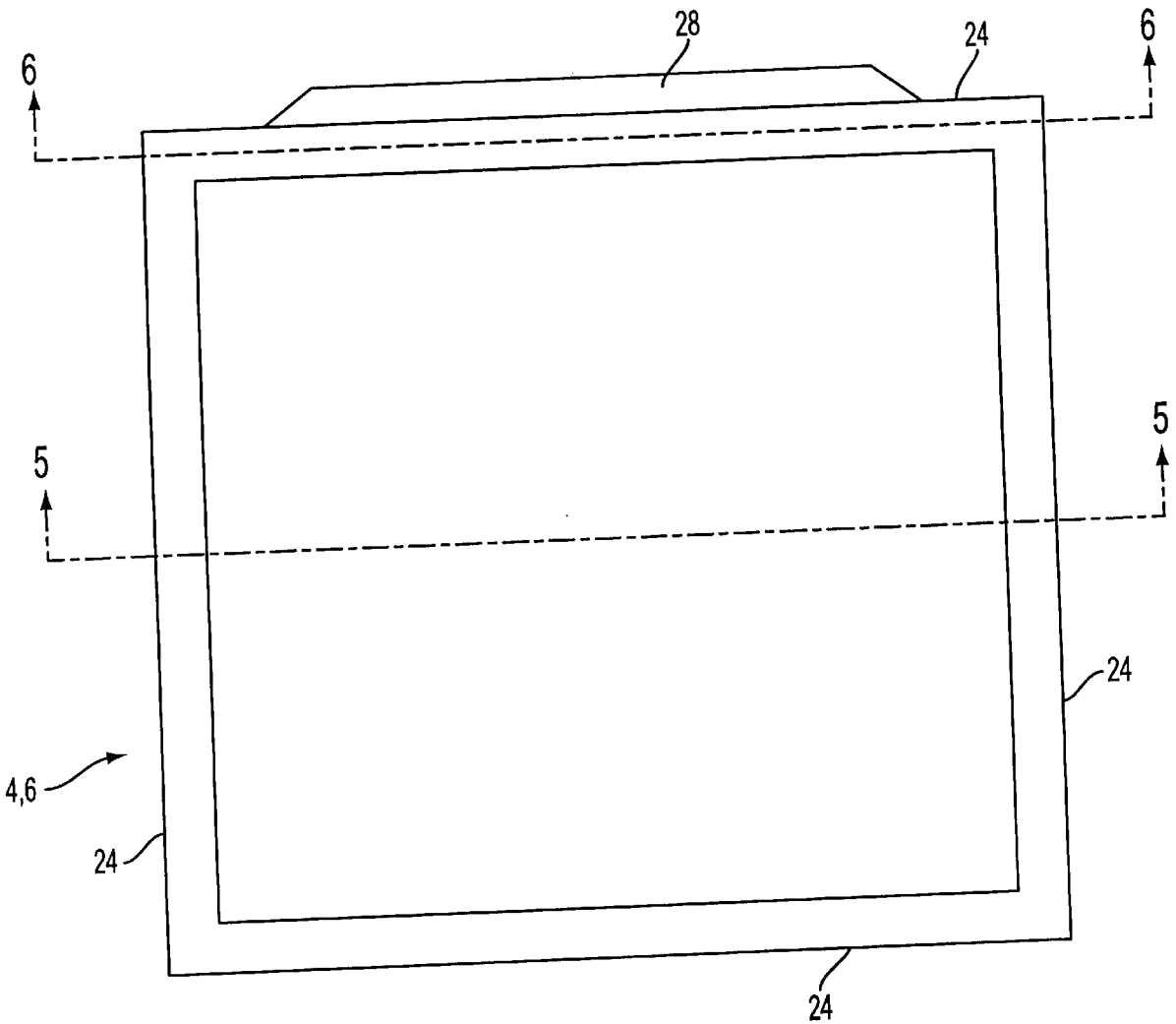
FIG. 2 is a front view of the sealing sheets of the pull-apart structure of the invention.
Figure 6:
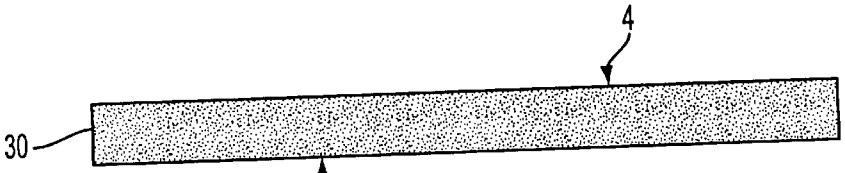
FIG. 6 is a section view not drawn to scale, through Section 6—6 of FIG. 2.
Figure 5:
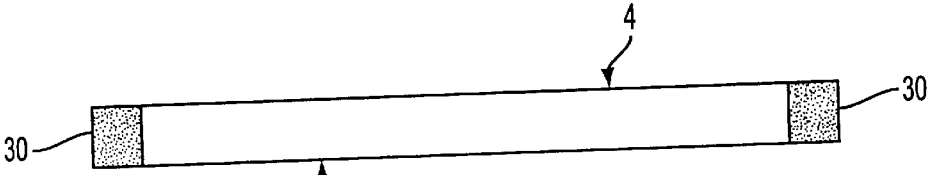
FIG. 5 is a section view, not drawn to scale, through Section 5—5 of FIG. 2.

Referring to FIGS. 1–6, the smoke mask of the invention includes a mask portion 2, adapted to be worn by a user in the presence of smoke to reduce smoke inhalation, and first and second sealing sheets 4 and 6 which form a pull-apart storage structure to seal mask portion 2 in an air and moisture impermeable package prior to use.

In order to provide filtration of smoke particles, mask portion 2 includes a breathable mask 8, which is preferably constructed of 100% cotton 10 oz. terry cloth material. In the alternative, mask 8 may be constructed of any single or multi-layered material, such as paper or a fibrous material, that is breathable and moisture absorptive, and that is resistant to breakdown in the presence of moisture. Various other types of filters are shown, for example, in the U.S. patents discussed above, the contents of each of which are incorporated herein by reference. A flexible strip 12, is attached to mask 8 by adhesive or the like to facilitate securing the mask to the bridge of the nose of the user, as described below. Flexible strip 12 is preferably a thin strip of metal, of the type known in the face mask field for this purpose. Alternatively, any appropriate flexible material may be used provided that it serves the function of securing mask 8 to the nose of the user. Flexible strip 12 may be secured to either surface of mask 8, or between the layers of mask 8 if a multi-layer structure is used.

Mask 8 is preferably rectangular-shaped, as shown in FIG. 1. Nonetheless, mask 8 may be constructed of any shape, provided that it is sized sufficiently to allow the user to breath when in use. For example, mask 8 may be more triangular shaped, which provides a more intuitive visual appearance to the user as to the proper way to attach the mask to the face.

Mask 8 is stored in a moistened condition, so that it will be immediately available for use by a user in a smoky condition. The mask is preferably moistened with water, either alone or in combination with other substances. In a preferred embodiment, mask 8 is also moistened with aloe, glycerin, and/or corn syrup, alone or in desired combinations. These substances are preferred to minimize the likelihood of face chapping when using the mask. Alternatively, various other substances, such as those disclosed in U.S. Pat. No. 5,322,060, may be utilized within the mask to neutralize the smoke, to filter particulates, or to serve any other useful function.

Disposed along an outer peripheral edge and secured to mask 8 is an attachment lip 10. Attachment lip 10 is preferably constructed of a flexible sheet plastic material or the like, which is secured to mask 8 by an adhesive that will not degrade in the presence of moisture, by stitching, or by other appropriate attachment means. Attachment lip 10 is coated on one side thereof with a pressure sensitive adhesive 20 of the type suitable for adhesion to human skin and releasable from the skin without injury. The adhesive is preferably hydrophobic in order to allow attachment to the skin even in the presence of moisture from sweat or the like that might be present on the skin in a smoke condition. In lieu of attachment lip 10, adhesive 20 may be located on mask 8 itself, either directly, or secured thereto on a sheet material, such as a two-sided tape. For example, one-side of a two-sided tape may be exposed and secured to the outer periphery of mask 8 during manufacture, preferably prior to moistening of the mask. The other side of the two-sided tape, which is coated with the hydrophobic pressure sensitive adhesive is exposed only during use of the mask, as discussed in detail below. Other alternatives include, for example, stitching a one-sided tape to mask 8, with the adhesive side of the tape only exposed during use, or attachment of two-sided tape to attachment lip 10.

Figure 7:
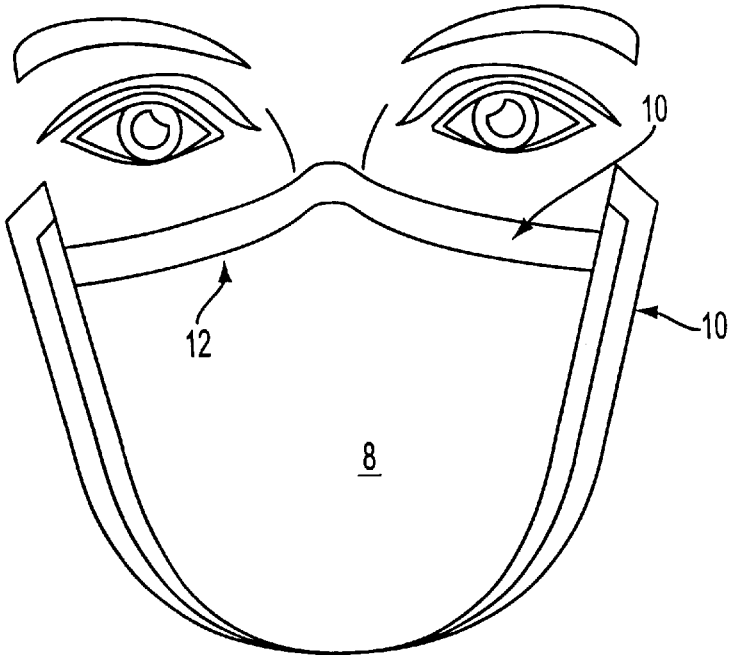
FIG. 7 is a front view of the mask of the invention attached to the face of a user.
Figure 8:
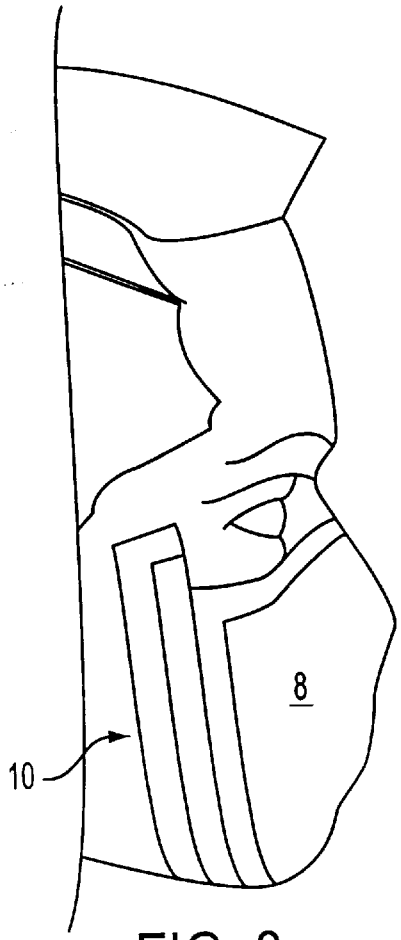
FIG. 8 is a side view of the mask of the invention attached to the face of a user.
Figure 9:
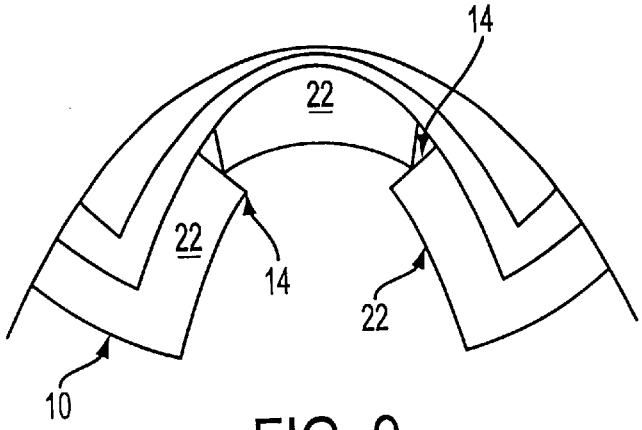
FIG. 9 is an underside view of the mask of the invention attached to the face of a user.
Figure 10:
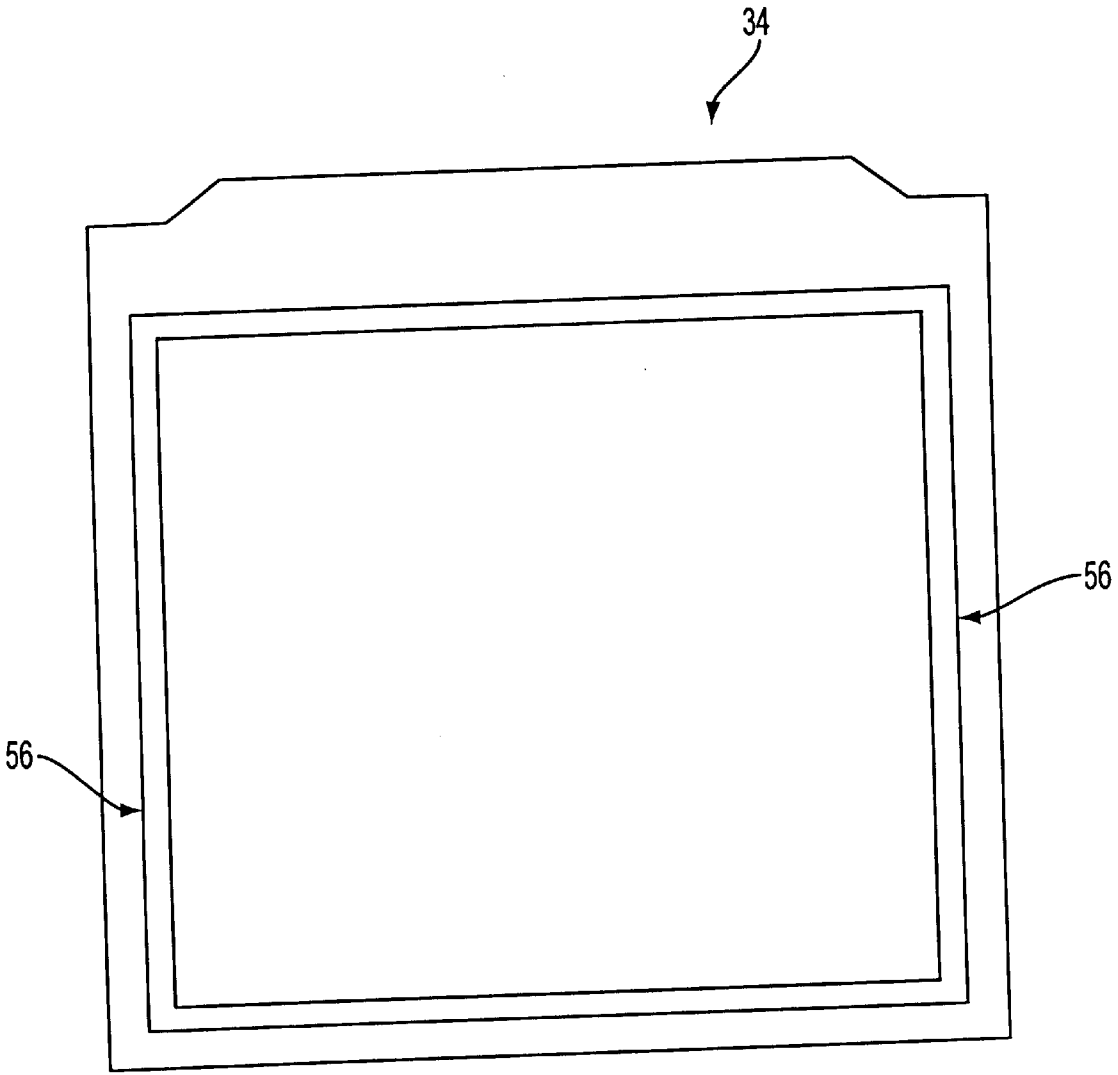
FIG. 10 is a front view of the front sealing sheet in an alternative embodiment of the invention.
Figure 11:
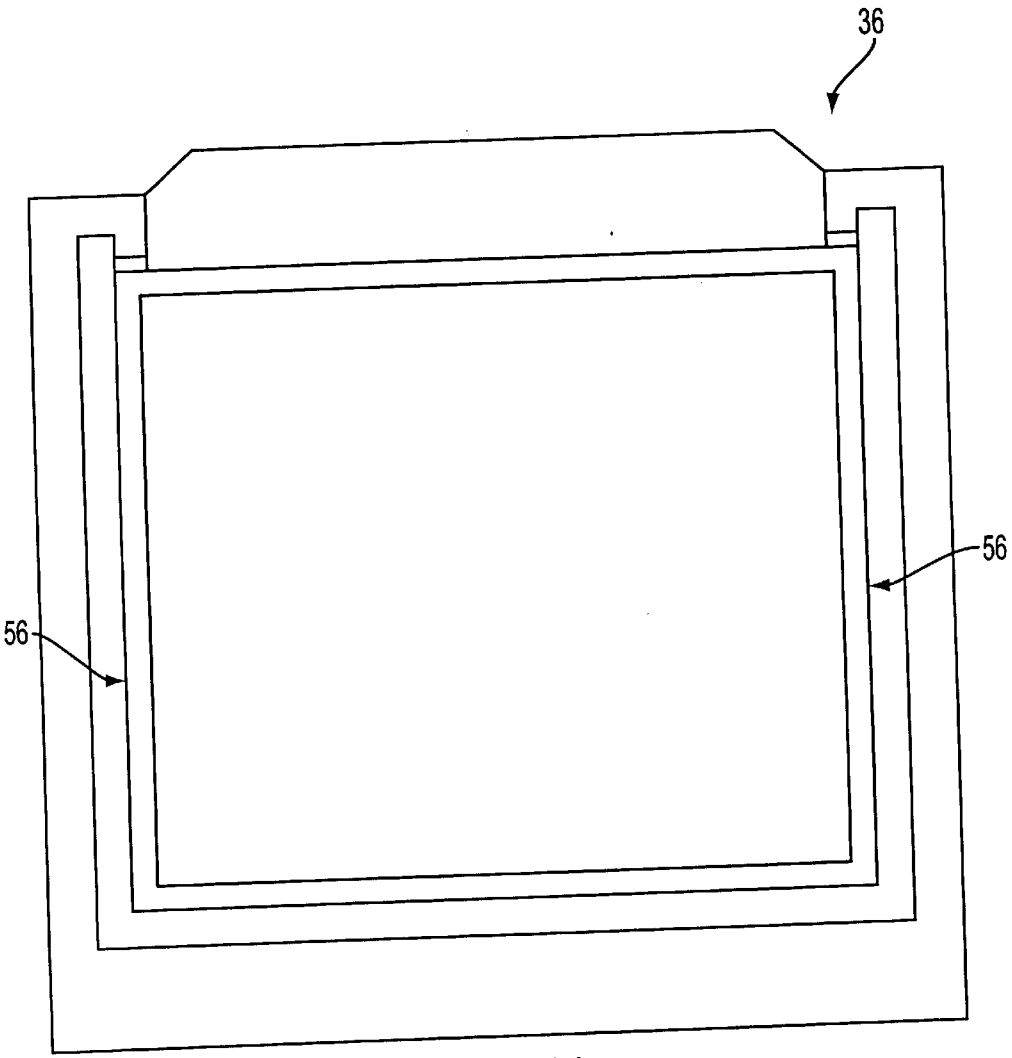
FIG. 11 is a front view of the rear sealing sheet in an alternative embodiment of the invention.
Figure 12:
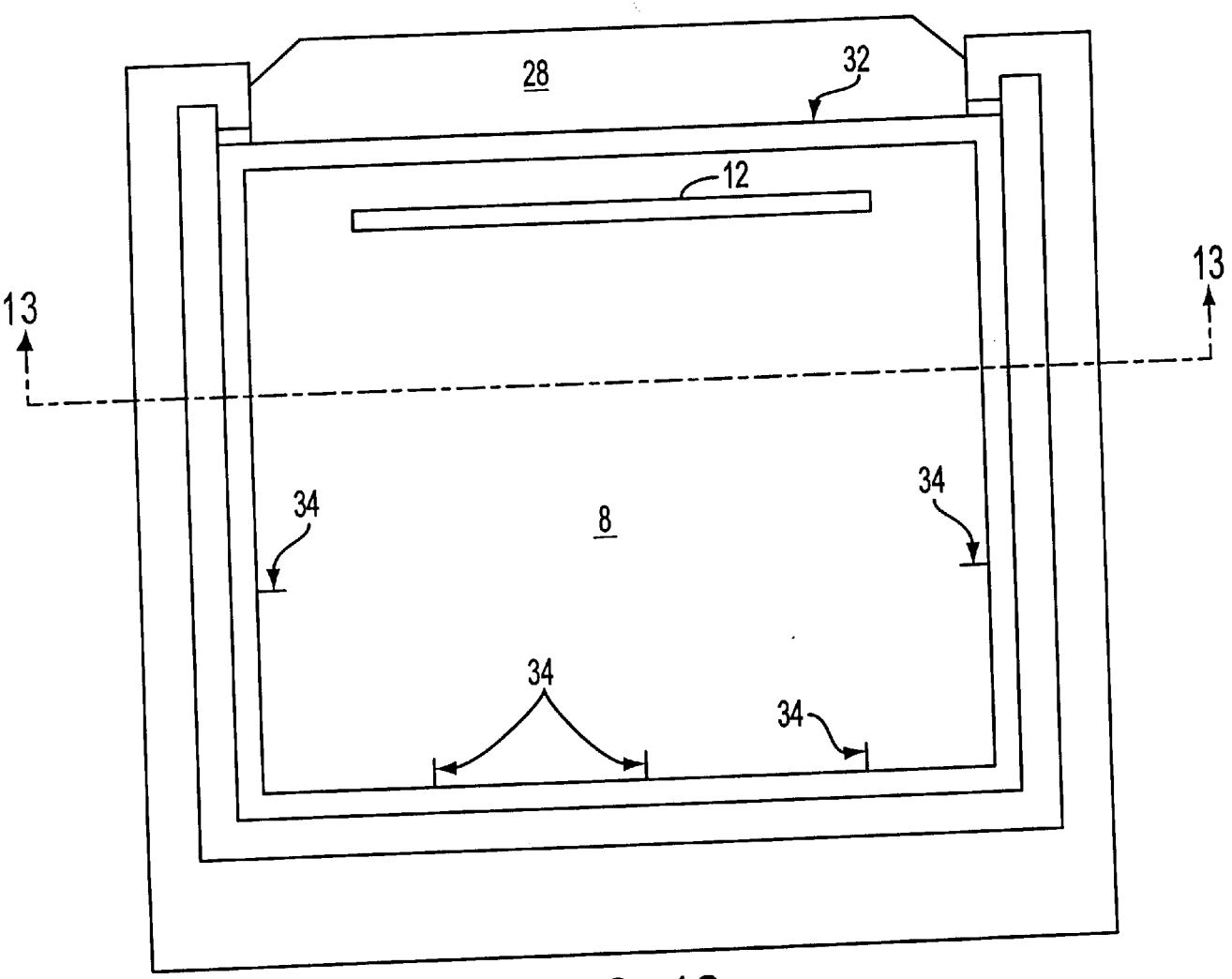
FIG. 12 is a front view of the mask of an alternative embodiment of the invention in the sealing structure for the mask.
Figure 13:
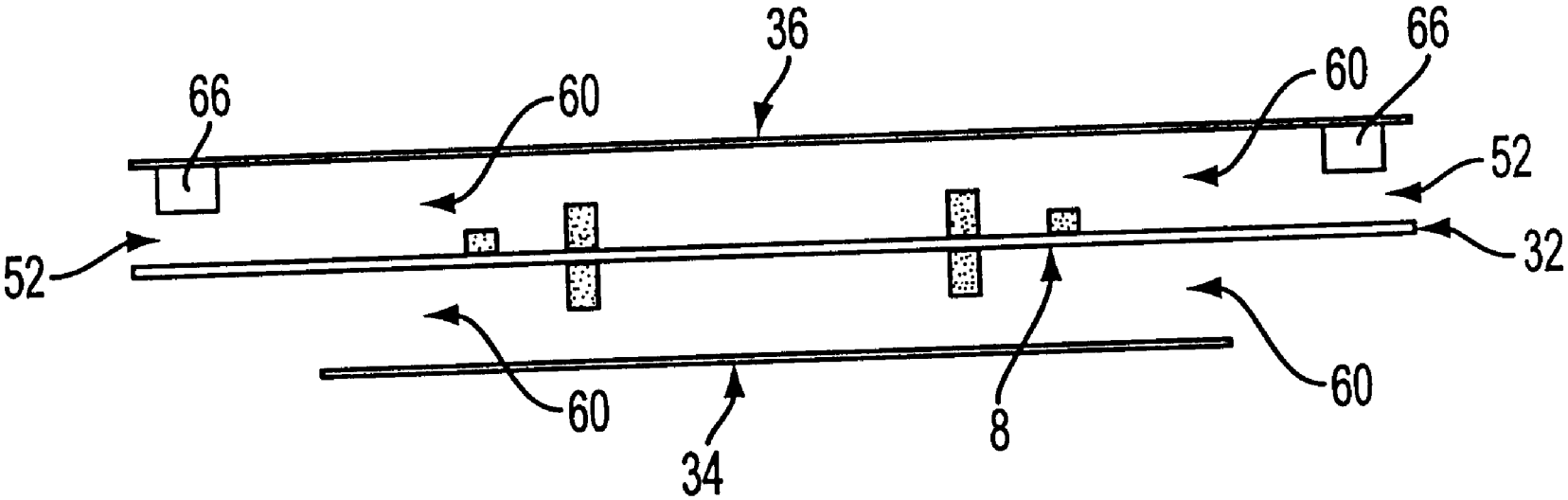
FIG. 13 is a section view, not drawn to scale, through Section 13—13 of FIG. 12.

Attachment lip 10 includes a number of slits 14 cut therein, as shown in FIG. 1, which may extend into mask 8 if desired. Slits 14 are provided in order to improve the fit of mask 8 on the face during use by preventing bunching of the mask due to the irregular facial features. Slits 14 permit the otherwise flat mask 8 to be fitted tightly to the face, as shown in FIGS. 7–9. During use, the adhesive on attachment lip 10 is exposed, as discussed below. The mask is applied to the face, with flexible strip 12 being bent to secure the mask portion to the bridge of the nose. Attachment lip 10 includes upstanding portions 16 and 18, which are pressed against the cheeks for adhesive 20 to attach thereto. Upstanding portions 16 and 18 include one or more slits 14 extending therethrough, which become slightly overlapped when the mask is applied to the cheeks to adjust to the curvature and contour of the face (not shown in FIGS. 7–9). Attachment lip 10 also includes a lateral portion 22, which is folded under the chin, and secured thereto by adhesive 20. In areas where bunching would normally occur, slits 14 are overlapped by the wearer to create a tight seal where attachment lip 10 is secured to the chin and cheeks. While flexible strip 12 provides a relatively tight fit of mask 8 to the bridge of the nose, if desired, attachment lip 10 may be extended laterally along the portion of the mask having flexible strip 12, thereby providing an adhesive attachment of the mask to the face along the entire periphery of the mask. If an attachment lip is not used, the slits may be cut in mask 8 itself.

Sealing sheets 4 and 6 together constitute a pull apart package for storing mask portion 2 until use. An outer peripheral edge 24 of each sealing sheet is sealingly attached to the outer peripheral edge of the other sealing sheet during manufacture to create an air and water-tight cavity between the sheets, in which mask 8 is stored until use. Mask 8 is pre-moistened before manufacture so that it is stored in a wetted condition. Sealing sheets 4 and 6 may be sealed together on their outer peripheral edges 24 by any appropriate sealing means 30, including pressure-sensitive, heat activated, or other adhesive, hot-glue, sonic welding, etc., provided that the sheets form an air and water-tight seal, and the sheets may be pulled apart with moderate physical pressure, preferably so that the pull-apart structure may be opened by a child. Sealing sheets 4 and 6 are preferably constructed of a translucent plastic, although any appropriate material may be used.

Each of the sealing sheets 4 and 6 preferably includes a pull tab 28 that enables the sealing sheets to be pulled apart and separated for use of mask portion 2. Pull tabs 28 are preferably integrally constructed with sealing sheets 4 and 6 and are formed by extending the peripheral edges of sheets 4 and 6 somewhat beyond outer peripheral edge 24, at which the sealing sheets are attached to one another. It is foreseen that tabs 28 may be separately attached to sealing sheets 4 and 6, or that alternative structures to pull apart the sealing sheets, e.g., pull cords, may be used.

Figure 4:
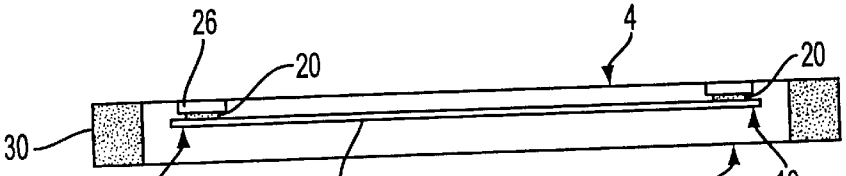
FIG. 4 is a section view, not drawn to scale, through Section 4—4 of FIG. 1.
Figure 3:
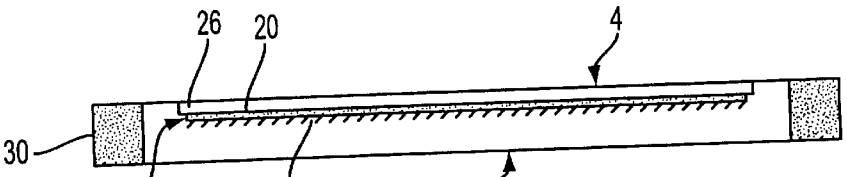
FIG. 3 is a section view, not drawn to scale, through Section 3—3 of FIG. 1.

One of the sealing sheets, in this case sealing sheet 4, is adapted to enable adhesive 20 to be exposed once the pull-apart structure is opened. In one embodiment of the invention, as shown in FIG. 4, adhesive 20 is covered by a release sheet covering 26, which is pulled from adhesive 20 to expose the adhesive. This type of release sheet covering is well known. In the invention, the side of the release sheet facing adhesive 20 is coated with, or constructed of, a material that releases from the adhesive when pulled therefrom. The other side of the release sheet covering is attached to sealing sheet 4 by any conventional means, such as with water-proof adhesive. After sealing sheets 4 and 6 are pulled apart, mask 8 will be left attached to sealing sheet 4 by release sheet covering 26. Mask 8 is then be pulled from sealing sheet 4, causing release sheet covering 26 to separate from adhesive 20, thereby exposing the adhesive and rendering the mask ready for use. It will be appreciated that the storage and release mechanism of the invention may be utilized with a mask of any size or shape, whether or not the mask includes slits 14.

Alternatively, it is foreseen that sealing sheet 4 may itself be used to cover adhesive 20 until use. In this embodiment, sealing sheet 4 may be covered on the portion thereof in contact with adhesive 20 by a release material, and pressed against adhesive 20 during manufacture to seal the adhesive. It will be appreciated that any appropriate material that releases from adhesive 20 may be used to coat sealing sheet 4, or sealing sheet 4 may be constructed in its entirety of a release sheet, provided that sealing sheet 4 is still capable of being attached to sealing sheet 6 to form the pull-apart structure.

In an alternative embodiment of the invention, as shown in FIGS. 10–14, the smoke mask includes a mask portion 32 and front and rear sealing sheets, 34 and 36 respectively, which form a pull-apart storage structure to seal mask portion 32 in an air and moisture impermeable package prior to use. In this embodiment, scaling sheets 34 and 36 seal to mask portion 32 to form the pull-apart structure, rather than sealing to each other as in the prior embodiment. Mask 32 is similar to the mask of the prior embodiment with the exceptions noted below, and like reference numerals are used to show corresponding structures. As in the prior embodiment, mask 8 is stored in a moistened condition, so that it will be immediately available for use by a user in a smoky condition.

Figure 14:
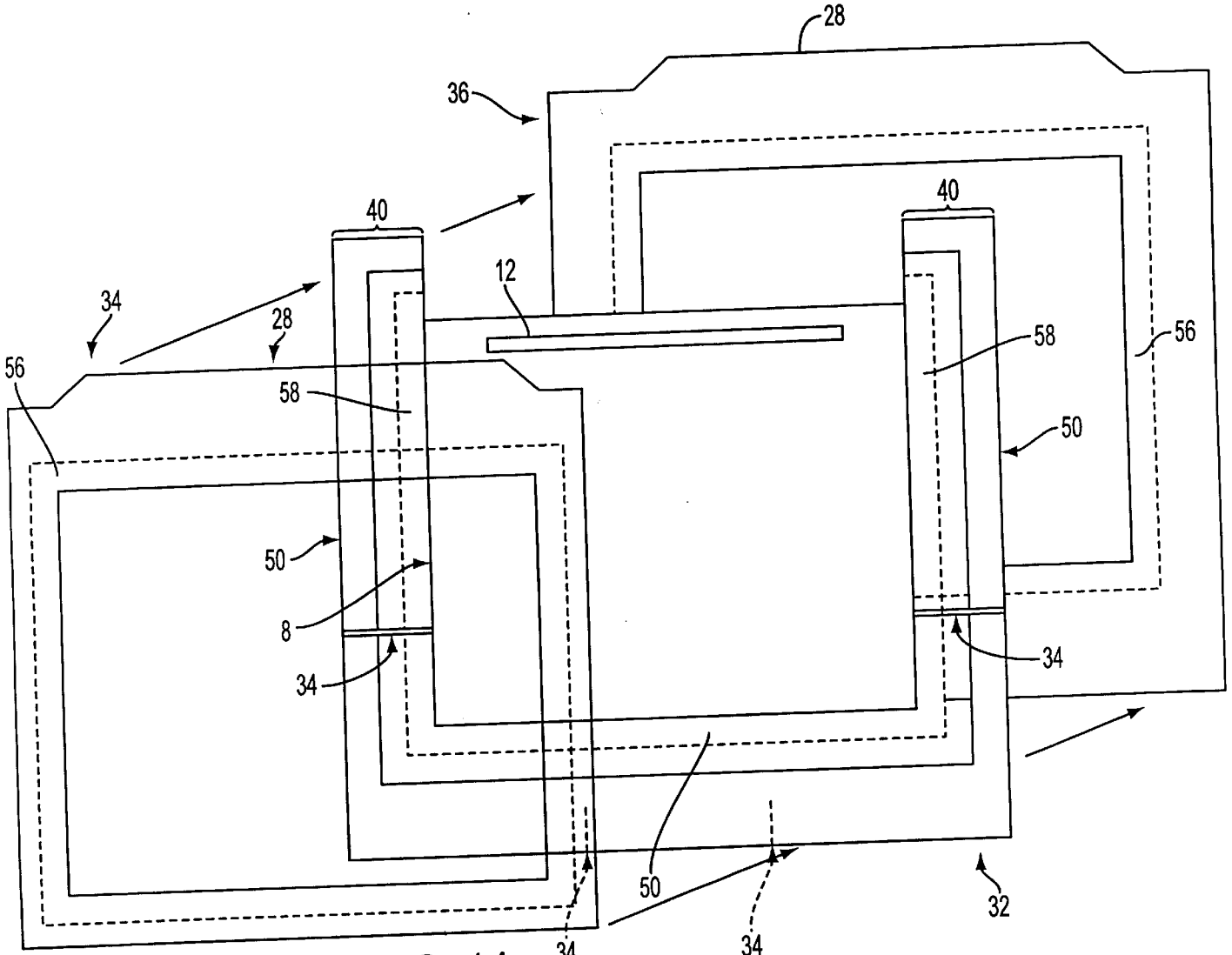
FIG. 14 is an exploded view of the alternative embodiment of the mask of the invention.

Secured to mask 8 is an attachment lip 40, which includes those portions of mask 32 extending peripherally outward from mask 8, as shown in FIG. 14, Attachment lip 40 is preferably constructed of a flexible sheet plastic material, which is secured to mask 8 by an adhesive that will not degrade in the presence of moisture, by stitching, or by other appropriate attachment means. An outer portion 50 of attachment lip 40 is coated on the side thereof facing rear sealing sheet 36 with a pressure sensitive adhesive 52 of the type suitable for adhesion to human skin and releasable from the skin without injury. Adhesive 50 is covered by sealing sheet 36, and exposed only when sealing sheet 36 is removed just prior to use.

Attachment lip 40 includes a number of slits 34 cut therein, as in the prior embodiment, to improve the fit of mask 8 on the face during use. Use of mask 8 is the same as in the prior embodiment, it being noted that outer portion 50 in this embodiment extends further up the cheeks than in the prior embodiment.

Sealing sheets 34 and 36 together constitute a pull apart package for storing mask portion 32 until use. Each of the sealing sheets 34 and 36 includes a sealing area 56 which includes an adhesive on the side thereof facing mask portion 32, Sealing area 56 of each sealing sheet is sealingly attached to a corresponding sealing area 58 on mask portion 32 during manufacture to create an air and water-tight cavity between the sheets, in which mask 8 is stored until use. Along a portion of mask 8 above flexible strip 12 over which peripheral lip 40 does not extend, sealing areas 56 of the sealing sheets seal to each other to complete the air and watertight seal of mask portion 32. If desired, peripheral lip 40 may be extended completely around mask 8 to eliminate the sealing of sealing sheets 34 and 36 to each other. Sealing sheets 34 and 36 are sealed to mask portion 32 and to each other by any appropriate sealing means 60, including pressure-sensitive, heat activated, or other adhesive, hot-glue, sonic welding, etc. Sealing sheets 34 and 36 are preferably constructed of a translucent plastic. Each of the sealing sheets 34 and 36 preferably includes a pull tab 28 that enables the sealing sheets to be pulled apart and separated for use of mask portion 32.

One of the sealing sheets, in this case rear sealing sheet 36, is adapted to enable adhesive 52 to be exposed once the pull-apart structure is opened. Adhesive 52 is covered by a release sheet covering 66, which is pulled from adhesive 52 to expose the adhesive. The side of the release sheet facing adhesive 52 is coated with, or constructed of, a material that releases from the adhesive when pulled therefrom. The other side of the release sheet covering 66 is attached to sealing sheet 36 by any conventional means, such as with adhesive. When sealing sheets 34 and 36 are pulled apart, mask 8 will be pulled from sealing sheet 36, causing release sheet covering 66 to separate from adhesive 52, thereby exposing the adhesive and rendering the mask ready for use. It is foreseen that sealing sheet 36 may itself be used to cover adhesive 52 until use by covering the portion thereof in contact with adhesive 52 with a release material.

FIGS. 15–18 show an alternative storage structure 100 for mask 32. Storage structure 100 is generally a conventional blister-pack storage structure consisting of a backing 102 and a cover portion 104. Backing 102 is preferably constructed of a cardboard or other material that is covered in printed material associated with mask 32. On the portion of backing 102 facing mask portion 32, backing 102 is preferably covered with a film of plastic or other waterproof material to prevent degradation of backing 102 from the moist environment in which mask 32 is stored, and to keep storage structure 100 water impermeable.

Figure 15:
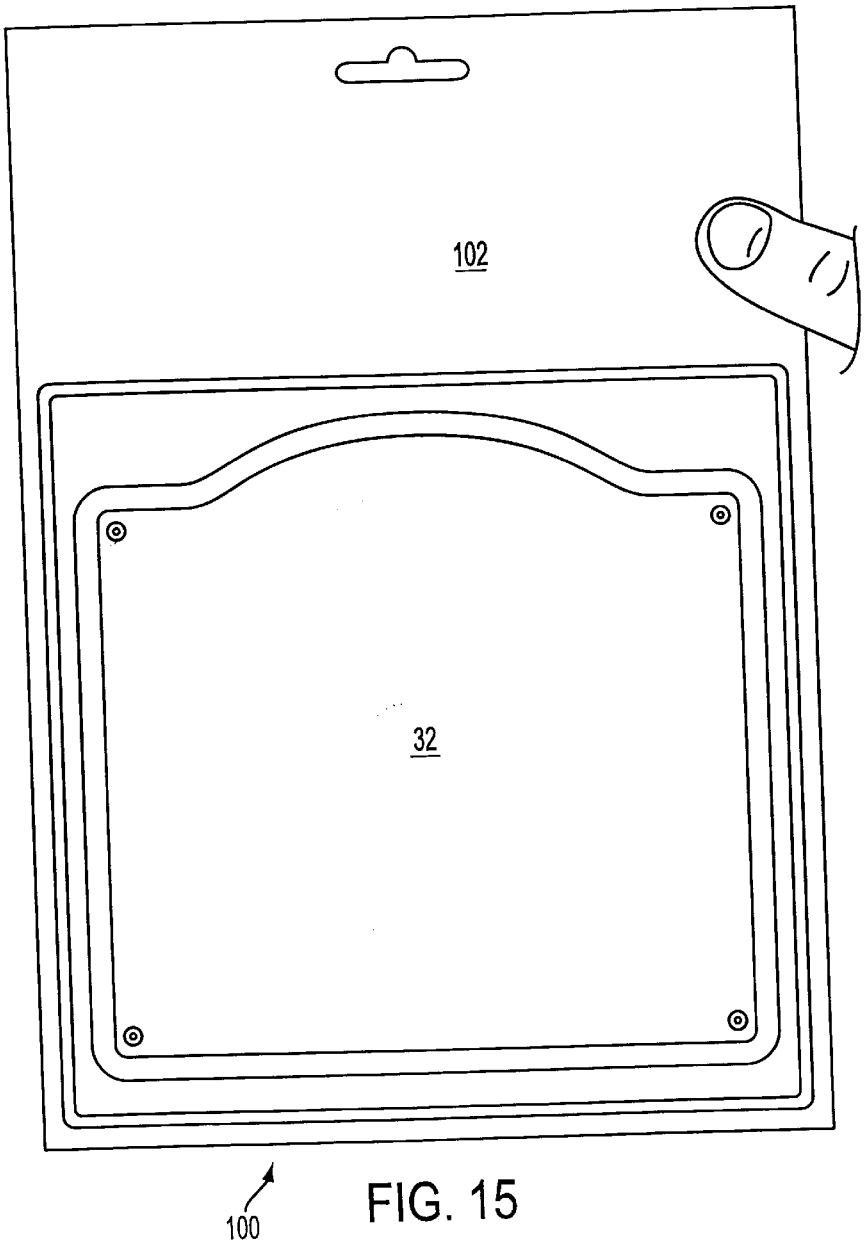
FIG. 15 is a front view of a blister-pack storage structure for the mask of the invention.
Figure 16:
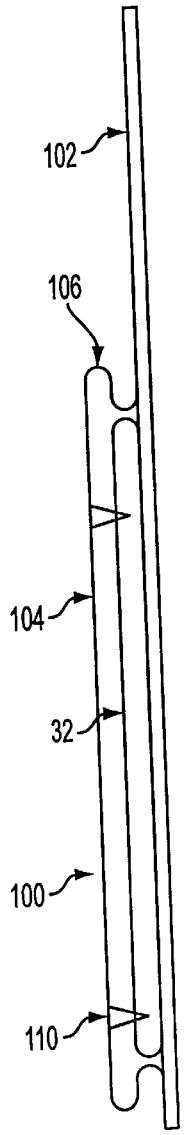
FIG. 16 is a side view of the storage structure shown in FIG. 15.
Figure 17:
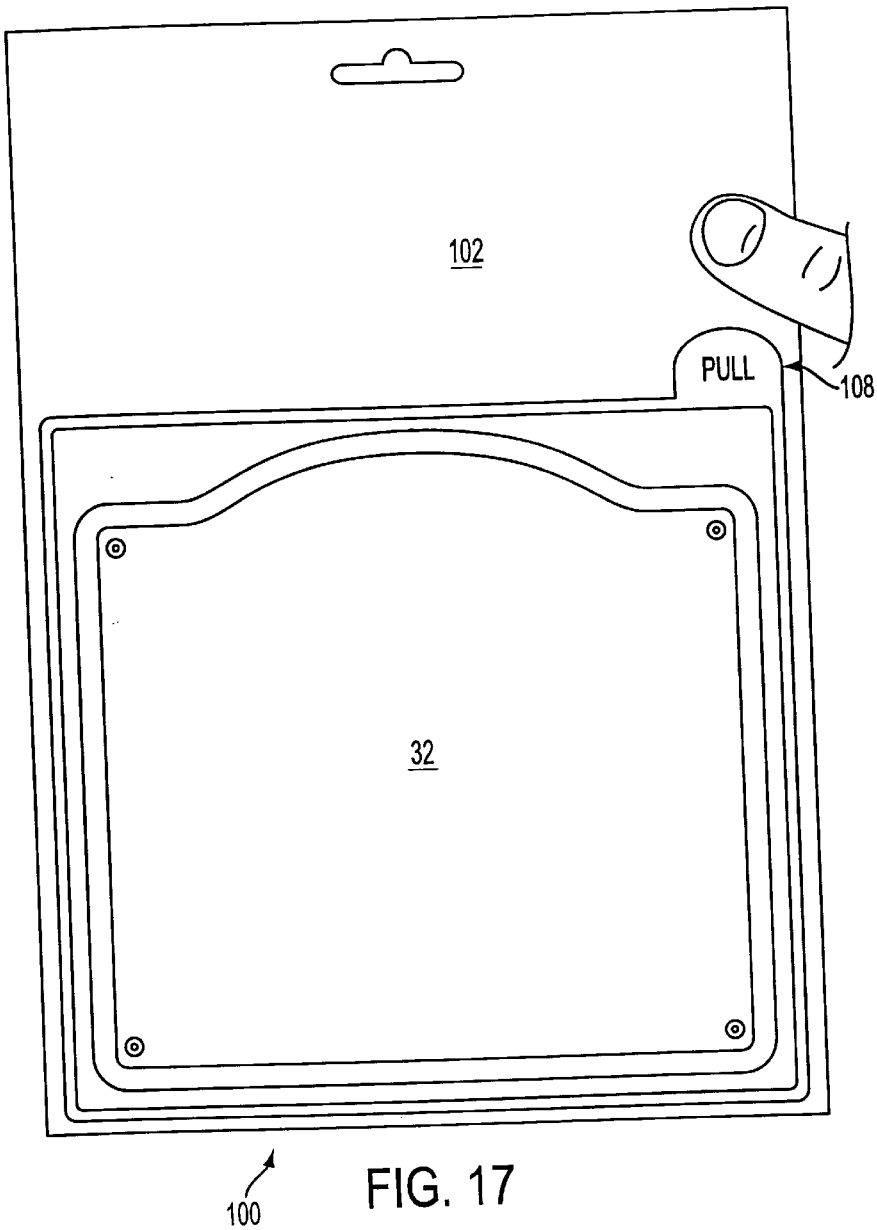
FIG. 17 is a front view of an alternative blister-pack storage structure for the mask of the invention.
Figure 18:
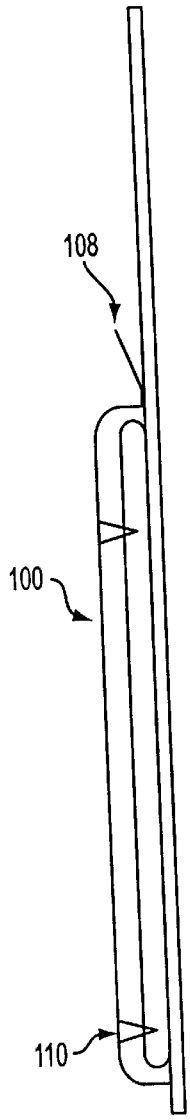
FIG. 18 is a side view of the storage structure shown in FIG. 17.

Cover 104 is preferably constructed of a vacuum formed plastic or other water impermeable material, and is preferably translucent to enable mask 32 to be seen from the exterior of storage structure 100. Cover 104 defines an interior cavity in which mask 32 is stored until use. Cover 104 is secured to backing 102 using any conventional water-proof adhesive that allows mask 32 to remain in a water-tight environment and that would allow the storage structure to be opened without undue manipulation in the event mask 32 is needed for use. As shown in FIGS. 15 and 16, cover 104 preferably includes a lip portion 106 running along at least one edge thereof, preferably along the entire edge. Lip portion 106 is preferably sized so that the lip may be grasped by a user and pulled away from backing 102 to rapidly open storage structure 100 in an emergency. Lip portion 106 is preferably integrally formed with cover 104. In an alternative embodiment, as shown in FIGS. 17 and 18, a tab 108 is attached to cover 104, preferably by being integrally formed therewith. To open storage structure 100, a user, while holding backing 102, pulls tab 108 with sufficient force to overcome the adhesive bond between cover 104 and backing 102, or to enable the plastic coating on backing 102 to tear away from or separate from the backing. It is foreseen that other opening mechanisms may be utilized in connection with storage structure 100, and that other alternative storage structures for mask 32 may be used as well.

On the side thereof facing backing 102, an outer peripheral edge of mask 32 is coated with an adhesive of the type described above to enable the mask to be applied to the face of a user. Backing 102 preferably includes a release tape on the surface thereof facing mask 32 so that the mask is attached to the release tape on backing 102. In use, once storage structure 100 is opened, mask 32 remains attached to backing 102, and may be used by pulling mask 32 off of the release tape, thereby exposing the adhesive on mask 32. It is foreseen that mask 32 may be mounted to any wall of the cavity formed by cover 104 and backing 102, so that, for example, mask 32 may remain attached to cover 104 when structure 100 is opened. If desired, protuberances 110 may be included on cover 104. Protuberances 110, which may be mounted to or integral with cover 104, apply pressure to mask 32 to maintain the adhesive on mask 32 in contact with the release tape on backing 102 in order to preserve the adherence of the adhesive.

Although the present invention has been described in detail with respect to certain embodiments and examples, variations and modifications exist that are within the scope of the invention as defined in the following claims.

What is claimed is as follows:

1. A smoke mask which comprises:

a moistened generally planar mask constructed of a moisture absorbing material, the mask sized to cover the nose and mouth of a user, the mask having a peripheral edge;

pressure sensitive adhesive on one side of the peripheral edge of the mask for securing the mask to the face of the user covering the mouth and nose of the user; and at least one slit in the peripheral edge of the mask for enabling the mask to adapt to the contour of the face of the user for obtaining a tight fit of the mask against the face of the user.

2. The smoke mask according to claim 1 wherein the at least one slit is oriented generally perpendicular to the peripheral edge of the mask.

3. The smoke mask according to claim 1 wherein the mask comprises portions thereof adapted to extend along the cheeks of the user, each of which comprises at least one slit.

4. The smoke mask according to claim 1 wherein the mask comprises a portion thereof adapted to extend under the chin of the user, which comprises at least one slit.

5. The smoke mask according to claim 4 wherein the mask portion under the chin of the user comprises a plurality of slits.

6. The smoke mask according to claim 1 further comprising a flexible strip attached to the mask along a portion thereof adjacent to the nose of the user.

7. The smoke mask according to claim 1 wherein the planar mask comprises a filtering portion and an attachment lip attached to the periphery of the filtering portion, the pressure-sensitive adhesive being disposed along a peripheral edge of the attachment lip.

8. The smoke mask according to claim 7 wherein the at least one slit is disposed at least partially in the attachment lip.

9. The smoke mask according to claim 1 in combination with a pull-apart storage structure, the pull-apart storage structure comprising first and second generally planar sealing sheets, each comprising an outer peripheral edge, the first and second sealing sheets being sealingly attached to each other along the outer peripheral edge for forming a moisture-impermeable hollow interior in which the moistened mask is disposed, the combination further comprising:

means for separating the first and second sealing sheets for removing the moistened mask disposed in the hollow interior of the pull-apart storage structure; and means for exposing the pressure sensitive adhesive upon removal of the moistened mask from the hollow interior of the pull-apart storage structure.

10. The combination according to claim 9 wherein the sealing sheets are constructed of a plastic material.

11. The combination according to claim 9 wherein the sealing sheets are sealingly attached to each other using adhesive, heat-sealing, or sonic welding.

12. The combination according to claim 9 wherein the means for separating the first and second sealing sheets comprises a tab formed by extending each of the first and second sealing sheets beyond the outer peripheral edge sealingly attaching the first and second sheets, the tab being sized to be grasped and pulled by a user.

13. The combination according to claim 9 wherein the means for exposing the pressure sensitive adhesive upon removal of the moistened mask from the hollow interior of the pull-apart storage structure comprises a release tape covering the pressure sensitive adhesive and attached to one of the sealing sheets.

14. The combination according to claim 9 wherein the means for exposing the pressure sensitive adhesive upon removal of the moistened mask from the hollow interior of the pull-apart storage structure comprises i) the surface of the sealing sheet facing the pressure sensitive adhesive being coated with a pressure sensitive adhesive release material, or ii) the sealing sheet facing the pressure sensitive adhesive being constructed of a release tape material.

15. The smoke mask according to claim 1 in combination with a pull-apart storage structure, the pull-apart storage structure comprising a backing and a cover, the cover comprising an outer peripheral edge sealingly attached to the backing for forming a moisture-impermeable hollow cavity in which the moistened mask is disposed.

16. The combination of claim 15 further comprising a grasping structure on the cover for enabling separation of the cover from the backing.

17. The combination according to claim 15 wherein the backing is constructed of a plastic coated cardboard and the cover is constructed of a clear plastic.

18. The combination according to claim 16 wherein the grasping structure is selected from the group consisting of a lip and a tab.

19. The combination according to claim 15 wherein the moistened mask is mounted to the backing and the pressure sensitive adhesive is exposed upon removal of the moistened mask from the backing.

20. A smoke mask in combination with a pull-apart storage structure for the smoke mask, the smoke mask comprising a generally planar mask having a peripheral edge, and a pressure sensitive adhesive on one side of the peripheral edge of the mask for securing the mask to the face of the user;

the pull-apart storage structure comprising first and second generally planar sealing sheets, each comprising an outer peripheral edge, the first and second sealing sheets being sealingly attached to each other along the outer peripheral edges thereof for forming a hollow interior in which the mask is disposed;

the combination further comprising:

means for separating the first and second sealing sheets for removing the mask disposed in the hollow interior of the pull-apart storage structure; and means for exposing the pressure-sensitive adhesive upon removal of the mask from the hollow interior of the pull-apart storage structure.

21. The combination according to claim 20 wherein the sealing sheets are constructed of a plastic material and are sealingly attached to each other using adhesive, heat-sealing, or sonic welding.

22. The combination according to claim 20 wherein the means for separating the first and second sealing sheets comprises a tab formed by extending each of the first and second sealing sheets beyond the outer peripheral edge sealingly attaching the first and second sheets, the tab being sized to be grasped and pulled by a user.

23. The combination according to claim 20 wherein the means for exposing the pressure sensitive adhesive upon removal of the moistened mask from the hollow interior of the pull-apart storage structure comprises i) a release tape covering the pressure sensitive adhesive and attached to one of the sealing sheets, ii) the surface of the sealing sheet facing the pressure sensitive adhesive being coated with a pressure sensitive adhesive release material, or iii) the sealing sheet facing the pressure sensitive adhesive being constructed of a release tape material.

24. The combination according to claim 20 wherein the planar mask is moistened, and is sized to cover the mouth and nose of the wearer.

25. The combination according to claim 20 wherein the planar mask comprises at least one slit in the peripheral edge of the mask for enabling the mask to adapt to the contour of the face of the user for obtaining a tight fit of the mask against the face of the user.

26. A smoke mask in combination with a pull-apart storage structure for the smoke mask, the smoke mask comprising a generally planar mask having a peripheral edge, and a pressure sensitive adhesive on one side of the peripheral edge of the mask for securing the mask to the face of the user, the pull-apart storage structure comprising a backing and a cover, the cover comprising an outer peripheral edge sealingly attached to the backing for forming a moisture-impermeable hollow cavity in which the moistened mask is disposed, the moistened mask being mounted to a wall of the cavity with the pressure sensitive adhesive being exposed upon removal of the moistened mask from the wall of the cavity.

27. The combination of claim 26 further comprising a grasping structure on the cover for enabling separation of the cover from the backing.

28. The combination according to claim 26 wherein the backing is constructed of a plastic coated cardboard and the cover is constructed of a clear plastic.

29. The combination according to claim 27 wherein the grasping structure is selected from the group consisting of a lip and a tab.

30. The combination according to claim 26 wherein the moistened mask is mounted to the backing and the pressure sensitive adhesive is exposed upon removal of the moistened mask from the backing.

* * * * *